US009784515B2

(12) United States Patent
Haimi

(10) Patent No.: US 9,784,515 B2
(45) Date of Patent: Oct. 10, 2017

(54) SYSTEM FOR ACTUATING GUN AND UTILITY LOCKS WITH AN EXTERNAL MOBILE DEVICE

(71) Applicant: LOCKING CONTROL LTD., Or Akiva (IL)

(72) Inventor: Shlomo Uri Haimi, Or Akiva (IL)

(73) Assignee: LOCKING CONTROL LTD., Or Akiva (IL)

( * ) Notice: Subject to any disclaimer, the term of this patent is extended or adjusted under 35 U.S.C. 154(b) by 0 days.

(21) Appl. No.: 14/777,751

(22) PCT Filed: Mar. 17, 2014

(86) PCT No.: PCT/IL2014/050296

§ 371 (c)(1),
(2) Date: Sep. 17, 2015

(87) PCT Pub. No.: WO2014/147616

PCT Pub. Date: Sep. 25, 2014

(65) Prior Publication Data

US 2016/0054080 A1 Feb. 25, 2016

Related U.S. Application Data

(60) Provisional application No. 61/802,683, filed on Mar. 17, 2013.

(51) Int. Cl.
*F41A 17/06* (2006.01)
*F41A 17/54* (2006.01)
(Continued)

(52) U.S. Cl.
CPC ..... *F41A 17/06* (2013.01); *F41A 17/46* (2013.01); *F41A 17/54* (2013.01); *F41C 33/029* (2013.01); *F41C 33/0263* (2013.01)

(58) Field of Classification Search
CPC ..... F41A 17/02; F41A 17/46; F41A 17/063; F41A 17/066
(Continued)

(56) References Cited

U.S. PATENT DOCUMENTS 4,488,370 A * 12/1984 Lemelson ..... E05B 49/006 42/70.01
5,062,232 A * 11/1991 Eppler ..... F41A 17/063 42/70.11
(Continued)

FOREIGN PATENT DOCUMENTS

| | | |
|---|---|---|
| WO | 02057701 | 7/2002 |
| WO | 02095317 | 11/2002 |
| WO | 2008151402 | 12/2008 |

*Primary Examiner* — Joshua Freeman
(74) *Attorney, Agent, or Firm* — Mark M. Friedman

(57) ABSTRACT

A safety holster, trigger lock and utility lock including an electronically actuated locking mechanism configured to admit the weapon or object into the device, and to engage a feature of the weapon, thereby preventing the withdrawal of the weapon prior to release of the electronically actuated locking mechanism; a control system including a microcontroller unit adapted to actuate the electronically actuated locking mechanism upon receipt of a control signal where the device provides for insertion of the weapon into the holster body/trigger guard, with the locking mechanism which admits the weapon during insertion, and which engages the weapon feature for retention of the weapon in a locked state upon receiving a locking control signal from an external device until the locking mechanism is disengaged by receiving an unlocking control signal from the external device.

27 Claims, 5 Drawing Sheets

(51) Int. Cl.
*F41C 33/02* (2006.01)
*F41A 17/46* (2006.01)

(58) Field of Classification Search
USPC ..... 42/70.11, 70.01, 70.07, 70.06, 66, 84
See application file for complete search history.

(56) References Cited

U.S. PATENT DOCUMENTS 5,713,149 A * 2/1998 Cady ..... F41A 17/04 42/70.06
5,828,301 A * 10/1998 Sanchez ..... F41C 33/029 224/244
6,223,461 B1 * 5/2001 Mardirossian ..... F41A 17/06 42/70.11
6,253,480 B1 * 7/2001 Florez ..... F41A 17/06 42/70.06
6,320,975 B1 * 11/2001 Vieweg ..... F41C 33/0227 224/193
6,711,844 B2 * 3/2004 Rumfelt ..... F41A 17/063 42/70.11
6,874,265 B1 * 4/2005 Pathak ..... F41A 17/54 42/70.06
8,740,026 B2 * 6/2014 Osborne ..... F41A 17/063 224/193
8,756,850 B2 * 6/2014 Dietel ..... F41A 11/02 42/70.11
2001/0033228 A1 * 10/2001 Kisreman ..... F41C 33/0263 340/568.1
2002/0032976 A1 * 3/2002 Riener ..... F41A 17/063 42/70.11
2002/0153396 A1 * 10/2002 French ..... F41C 33/0209 224/244
2011/0162514 A1 7/2011 Osborne
2013/0103946 A1 * 4/2013 Binenstock ..... H04L 63/0492 713/168
2014/0215881 A1 * 8/2014 Milde, Jr. ..... F41A 35/00 42/70.06
2014/0215882 A1 * 8/2014 Milde, Jr. ..... F41A 17/066 42/70.06
2014/0259841 A1 * 9/2014 Carlson ..... F41A 17/063 42/1.01
2014/0366420 A1 * 12/2014 Hager ..... F41A 17/063 42/70.11
2015/0068093 A1 * 3/2015 Milde, Jr. ..... F41A 17/063 42/70.11
2015/0176937 A1 * 6/2015 Sullivan ..... F41A 17/063 42/84
2015/0184963 A1 * 7/2015 Milde, Jr. ..... F41A 17/066 42/70.06
2015/0184964 A1 * 7/2015 Milde, Jr. ..... F41A 17/066 42/70.11
2015/0247692 A1 * 9/2015 Harvey ..... F41A 17/00 42/70.11
2015/0254968 A1 * 9/2015 Sanders ..... F41C 33/029 340/539.13
2016/0033222 A1 * 2/2016 Milde, Jr. ..... F41A 17/066 42/70.11
2016/0054080 A1 * 2/2016 Haimi ..... F41A 17/06 42/70.06

* cited by examiner

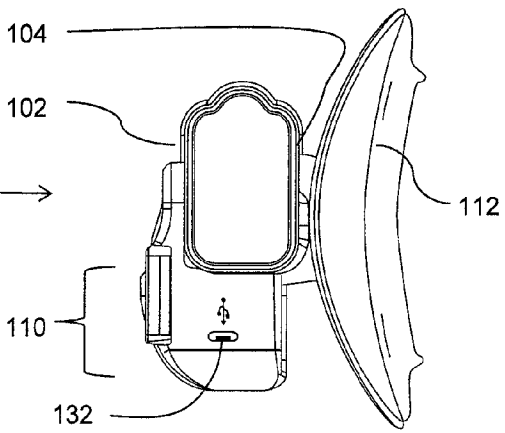
Fig. 1F Muzzle-end View
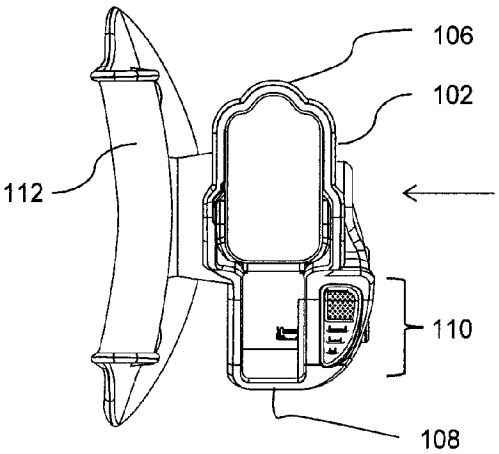
Fig. 1E Handle-end View
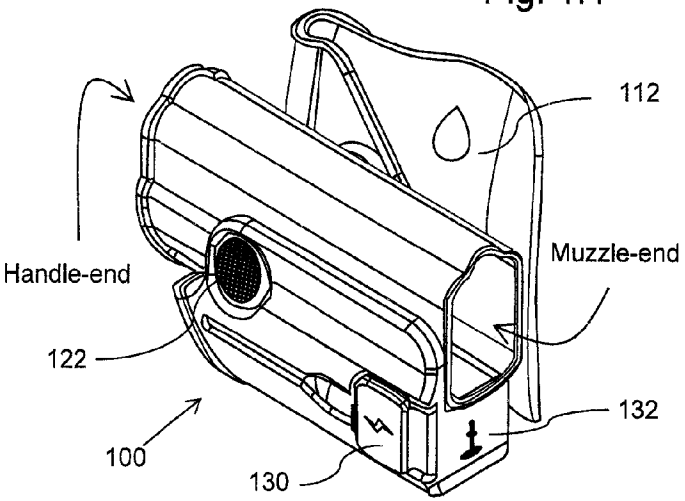
Fig. 1H
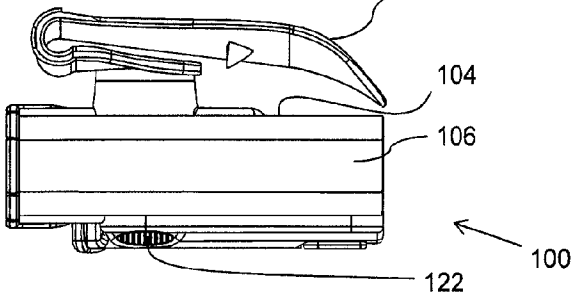
Fig. 1G Top View

SYSTEM FOR ACTUATING GUN AND UTILITY LOCKS WITH AN EXTERNAL MOBILE DEVICE

This patent application claims priority from, and the benefit of, U.S. Provisional Patent Application No. 61/802,683, filed Mar. 17, 2013

FIELD AND BACKGROUND OF THE INVENTION

The present invention relates to a firearm safety and, more particularly, to a device and method for controlling, managing and monitoring the safe use of firearms, remotely using an external mobile device.

Many incidents have occurred where off-duty guards/soldiers/law enforcement officers have used the weapon entrusted to them in order to commit crimes, most often, murder or attempted murder, or otherwise discharge the weapon in an unauthorized manner. In addition, there are countless incidents in which unauthorized people, especially young children, manage to obtain firearms, often unintentionally (or intentionally) discharging the firearm. This type of occurrence is very prevalent in the home setting and causes many cases of harm to human life and wellbeing.

Numerous gun and trigger locks are known in the art, as well as several types of gun vaults. All of these devices suffer from several drawbacks, some of which include: a) placing the responsibility for safeguarding the weapon on the owner or user of the weapon and on their ability to manage the firearm safety issues; b) needing the owner/user to be physically present to lock or unlock a firearm; c) requiring the use of an actual key or combination—both of which can be lost and/or forgotten, d) are difficult to manage once more than one weapon is in the same location and, most worrisome, e) both present an easy opportunity for unauthorized people to gain access to such weapon.

Furthermore, the locks are generally designed for securing the weapon in the home. These devices fail to secure weapons in transit from a place of work to the home. Still further, currently available solutions do not provide any indication as to location and/or status of the weapon.

Remote locking systems exist in modified weapons. These devices suffer from the drawback of being specialized weapons where both technological and mechanical changes have to be integrated into the body of the weapon. This leads to an expensive and cumbersome solution. Un-modified weapons, which include the vast majority of weapons, cannot benefit from the aforementioned integrated technology. Furthermore, mechanically altering a weapon creates an operational issue because it adds an additional technological/mechanical feature that could malfunction when the weapon is needed. Such an addition to malfunction ratios is a major issue for weapon owners, private security and law enforcement officers.

It would be highly advantageous to have a device and method for remotely securing a weapon when not in use (e.g. when off-duty or when not under care if the owner), when referring to organizational weapons (such as private security and/or law enforcement) by a second party and not the only the user. It would further be advantageous to have a device and method for remotely securing any type of weapon, including but not limited to a handgun, even during transit to and from a place of work, when the weapon is being used in the line of duty. Furthermore, it would be highly advantageous to have a device and method for receiving reminders, additional data and information as to the location, and status of a weapon, including but not limited to: automatically, by use of default settings, by specific demand of the user or another authorized user. Furthermore, it would be highly advantageous to have a device and method for remotely securing a weapon, where the integral body of the weapon is not modified.

Definitions

Cellular Technology

Cellphones, Smartphones and other mobile phones communicate with each other over a cellular network (e.g. Global System for Mobile Communications—GSM). Some portable computing devices such as PDAs, tablet computers and laptops can use SIM cards or cellular modems to access the cellular networks. The earlier generation cellular technology included voice and later SMS capabilities. Later generation cellular technology further included data communications, such as General packet radio service (GPRS), which is a packet oriented mobile data service on the 2G and 3G cellular communication system's GSM. 4G mobile telecommunications technology, in addition to usual voice and other services of 3G system, provides mobile ultra-broadband Internet access. Conceivable applications include amended mobile web access, IP telephony, gaming services, high-definition mobile TV, video conferencing, 3D television, and cloud computing.

Satellite Technology

The Global Positioning System (GPS) is a space-based satellite navigation system that provides location and time information in all weather conditions, anywhere on or near the Earth where there is an unobstructed line of sight to four or more GPS satellites. The technology has been around for at least 40 years. In the last approximately 20 years, GPS technology has been available for civilian use. Since then, dedicated devices have been available on the commercial market. Approximately 10 years ago, mobile phones started carrying GPS capable technology. Today, most smartphones, tablet computers, mini-tablets and other portable computing devices carry GPS technology.

Short-rang/Local Wireless Technology

A plethora of wireless technologies exist today. Many of those technologies have only a short working range. Bluetooth, WiFi, RFID and NFC are a small sampling of the short-range wireless technologies. Most mobile phones and portable computing devices include at least one, and sometimes two, three or more, short-range wireless technologies.

Wired Technology

Almost all mobile devices and portable computing devices include a data port that can be used to connect the device to another computer. For example, laptops includes one or more USB ports, Apple® devices (e.g. iPhone™, iPad™, etc.) have specialized data ports, Android™ devices (smartphones, tablets etc.) usually include mini-USB or micro-USB ports. The data ports allow the mobile phone or portable computing device to connect to other devices for the purpose of one- or two-way data communication/transfer. Data ports, docking ports, USB cables and connectors are generally capable of transferring power in addition to data. For example, a smartphone connected to a laptop not only allows for transfer of data between the devices but in many cases the laptop also charges the smartphone battery at the same time.

The terms "mobile device", "mobile communications device", "mobile phones", "handsets" and similar variations refer herein generally to a cellular phone, and in some embodiments, refer to a cellular phone enabled with either GPS capabilities or similar satellite-based positioning capabilities that can pin-point the X and Y coordinates or X, Y and Z coordinates of the device. Global Navigation Satellite System (GNSS) receivers, using the GPS, GLONASS, Galileo or Beidou system, are used in many applications. For simplicity sake, the terms "GPS" or "GPS-like" will be used in this document but it is to be understood that this is only an exemplary reference. The GPS device may either be integrated into the mobile handset or an external device coupled (wired or wireless) to the handset.

'Mobile device', 'smart phone', 'cell-phone', 'cellular device' and similar terms are used interchangeably here, generally referring to a mobile handset with at least celluar telephonic communications capabilities, computing capabilities, as well as wireless local/short-range data communication capabilities (e.g. Bluetooth™, RFID, NFC etc.), unless otherwise specified. Mobile devices having the aforementioned capabilities are commonly referred to as smartphones. In some embodiments, the mobile devices also include GPS-like technology. The current invention pertains equally to mobile/portable computing platforms having the same capabilities, even those not generally used for telephonic communications (e.g. PDAs) or even lacking such features (e.g. tablet or laptop computers etc.).

Portable/Mobile Computing Device Not Limitive

The present invention anticipates a wide variety of applications for the remotely activated gun and utility locks taught herein. Within the application context, the term "portable computing device", "mobile computing device", "mobile device" and variants thereof should be given the broadest possible interpretation, to include but not be limited to laptop computers, cellphones, smart phones, tablet computers, mini tablets and other like and typical applications where computing devices are configured in a portable or semi-portable manner. While the present invention anticipates that the computational capability of the "computing device" described herein may vary widely, it is anticipated that some aspects of the present invention may be implemented using software embodied in computer readable program code means embodied on a tangible medium that is computer readable.

Wearable technology is also considered to be within the meaning of portable computing devices. Wearable technology, wearable devices, tech togs, or fashion electronics are clothing and accessories incorporating computer and advanced electronic technologies. The designs often incorporate practical functions and features, but may also have a purely critical or aesthetic agenda. One well known wearable technology is Google Glass™. Google Glass is a wearable computer with an optical head-mounted display (OHMD) that is being developed by Google, headquarted in Mountain View, Calif., U.S. Another well known line of wearable computing devices is Samsung Gear™ produced by Samsung Electronics, Suwon, Gyeonggi Province, South Korea. Samsung Gear products include the Android Smartwatch which is a computerized wristwatch. Some advanced smartwatches have technological capabilities similar to those of smartphones.

Computing Device Not Limitive

The present invention may make use of a wide variety of computing devices in its general theme of construction. While microcontroller unit (MCU) construction may be optimal in many circumstances, the present invention is not limited to this particular form of construction and the term "computing device" and "MCU" should be given their broadest possible definitions in this context.

Weapon Not Being Limitive

The present invention anticipates a wide variety of gun locks. The terms 'weapon', 'firearm', 'handgun', 'gun' and variations of the same are mentioned numerous times in the disclosure. These term are used interchangeably and are not intended to be limiting in any way. For the sake of clarity, various embodiments of gun locks, and specifically trigger locks or trigger-guard locks are anticipated. Any weapon, fiream, handgun, gun and the like that discharges ordinance (directly or indirectly) by actuating a trigger and includes a trigger guard or other construction that can be utilized to immobilize the trigger and/or restrict access to the trigger—is included in the scope and meaning of the aforementioned terms (gun locks, trigger locks).

INVENTION NOMENCLATURE

The two types of wireless technologies readily available on most mobile devices can generally be divided into Local Area Wireless Communication (LAWC) technology and Wide Area Wireless Communication (WAWC) technology (elements of the aforementioned names are borrowed from the computer technology terminology Local Area Networks and Wide Area Networks, although no inferences should be made between the two technologies). The term 'communication' with reference to LAWC and WAWC can be two-way communication or only one-way communication. The communication medium may be sound waves, electromagnetic energy such as radio waves, light waves and the like.

An example of the LAWC technology is Bluetooth™ (BT), but it is understood that the use of Bluetooth technology herein is merely exemplary and that other communication technologies such as, but not limited to, RFID, NFC IrDA, UWB and others may be employed in place of Bluetooth.

Examples of WAWC include cellular communication and satellite communication. In some instances the distinction between LAWC and WAWC may not be so clear, but in general the given definitions will suffice to distinguish between technology types employed within the scope of the invention.

The LAWC enabled device passes information "on contact" with other people or entities automatically, semi-automatically and/or manually. The terms "contact", "vicinity" and "proximity", as used herein, refer to physically close proximity between two parties, which can be defined as a range of distance between the two entities or the ability to initiate direct Bluetooth discovery or other technology that detects a direct location link between two people (e.g. using RFID reader or NFC communication). Proximity is defined as the upper range of data communication capabilities for short-range communication technology.

A number of exemplary short-range technologies and their approximate transmission/communication ranges follow. Bluetooth technology transmits up to approximately 30 meters or 100 feet. RFID technology has a number of different ranges, depending on various factors. Typically, the read range is approximately between 3 and 300 feet (1-100 meters). RFID readers can read tags in smart cards from about 3 feet; tags on pallets and cases of goods can be read from approximately 20-30 feet and battery-powered tags (e.g. tags used in toll collection) up to approximately 300 feet. NFC technology can typically transmit data over a distance/range of between 4 cm and 1.2 m.

SUMMARY OF THE INVENTION

According to the present invention there is provided a safety holster for use with a weapon, the weapon having a barrel, a slide, a trigger guard, a trigger, an ejection port, a hammer end and a handle, wherein the holster includes: a holster body that includes spaced apart strap-side and outer-side substantially rigid sidewalls formed to define an inner cavity and an open handle-end portion for receiving a weapon therein, and for removing the weapon there from, the holster body having a long axis parallel with the barrel of the weapon when secured in the holster body; an electronically actuated locking mechanism configured to admit the weapon into the safety holster, and to engage a feature of the weapon, thereby preventing the withdrawal of the weapon prior to release of the electronically actuated locking mechanism; a control system including a microcontroller unit adapted to actuate the electronically actuated locking mechanism upon receipt of a control signal; the safety holster provides for insertion of the weapon into the holster body, with the locking mechanism which admits the weapon during insertion, and which engages the weapon feature for retention of the weapon in a locked state upon receiving a locking control signal from an external device until the locking mechanism is disengaged by receiving an unlocking control signal from the external device.

According to further features in preferred embodiments of the invention described below the safety holster further includes a trigger-guard enclosure that includes spaced apart strap-side and outer-side substantially rigid sidewalls formed to define an inner cavity and an open handle-end portion for receiving the trigger guard of the weapon therein, and for removing the trigger-guard of the weapon there from, the trigger-guard enclosure having a long axis parallel with the trigger guard of the weapon when secured in the trigger-guard enclosure.

According to still further features in the described preferred embodiments the external device is a mobile device.

According to still further features in the described preferred embodiments the device further includes a data connector, adapted for operationally coupling the electronically actuated locking mechanism to the mobile device such as a cellular communications device and/or a satellite communications device and/or a portable computing device.

According to still further features in the described preferred embodiments the data connector is a docking port for the mobile device or is operationally coupled to the mobile device via a wired means and/or is also a power port for receiving power from an external device.

According to still further features in the described preferred embodiments the control signal is received via a wired communication and/or a wireless communication where the wireless communication is a Local Area Wireless Communication (LAWC) and/or a Wide Area Wireless Communication (WAWC).

According to still further features in the described preferred embodiments the mobile device receives the control signal from a remote source over WAWC technology.

According to still further features in the described preferred embodiments the control signal is sent only after a biometric sample has been captured and approved via the mobile device and wherein the biometric sample is selected from the group consisting of: a fingerprint, a retinal scan, facial recognition, and a voice print.

According to still further features in the described preferred embodiments the control signal is sent only after a geospatial position of the security holster is ascertained and approved and wherein the geospatial position is ascertained and approved via the mobile device.

According to another embodiment there is provided a trigger lock for a weapon having a frame, a trigger and a trigger guard, the trigger lock including: a trigger-guard enclosure including a body component and a locking pin component, that together define an inner cavity and an open entry channel for receiving the trigger guard of a weapon therein, and for removing the trigger-guard of the weapon there from, the trigger-guard enclosure having a long axis parallel with the trigger guard of the weapon when secured in the trigger-guard enclosure; an electronically actuated locking mechanism configured to admit the trigger guard therein, and to engage the trigger guard of the weapon, thereby preventing the withdrawal of the trigger guard prior to release of the locking mechanism; a control system including a microcontroller unit adapted to actuate the electronically actuated locking mechanism upon receipt of a control signal; the trigger lock provides for insertion of the trigger guard into the trigger lock, with the locking mechanism which admits the trigger guard during insertion, and which engages the trigger guard for retention of the trigger guard in a locked state upon receiving a control signal from an external device, thereby restricting access to the trigger, until the locking mechanism is disengaged by receiving the control signal from the external device.

According to further features in the described preferred embodiments the electrically actuated locking mechanism includes a locking tab movable between a locked and an unlocked position, engaging the trigger guard in the locked position.

According to still further features in the described preferred embodiments the body component includes a first cover member and a coupling element, the cover member having a surface area large enough to restrict access to the trigger and the locking pin component includes a second cover member, substantially corresponding in size and shape to the first cover member; the locking pin component further including a shaft section which is adapted to pass through an area defined by the trigger guard and a frame of the weapon, and fit into a coupling element of the body component; the body and locking pin components are separately positioned on either side of the trigger-guard and locked together about the trigger-guard in a manner which prevents actuation of the trigger; the electrically actuated locking mechanism including a locking tab movable between a locked and an unlocked position adapted to releasably couple the locking pin component to the body component by locking the shaft section with the coupling element in a locked state and unlocking the shaft section from the coupling element in an unlocked state.

According to still further features in the described preferred embodiments the trigger lock further including a data connector, adapted for coupling the external device to the trigger guard lock.

According to still further features in the described preferred embodiments the control system further includes a wireless transceiver adapted to receive wireless transmissions from the external device.

According to another embodiment there is provided a utility lock, including:

a lock body having a locked state and an unlocked state; an electronically actuated retention mechanism including a locking tab moveable between a locked position and an unlocked position, a microcontroller unit (MCU) adapted to manipulate the electronically actuated retention mechanism upon receipt of a control signal; and the lock body being transformed into in a locked state by moving the locking tab into a locked position upon receiving a locking control signal from an external device, and transforming the lock body into an unlocked state by moving the locking tab into an unlocked position upon receiving an unlocking control signal from the external device.

According to still further features in the described preferred embodiments the external device is operationally coupled to the lock body by a physical medium and/or via a wireless medium.

The present invention provides a device and method for remotely securing a weapon when not in use (e.g. when off-duty or when not under care if the owner), when referring to organizational weapons (such as private security and/or law enforcement) by a second party and not the only the user. There is also provided a device and method for remotely securing any type of weapon, including but not limited to a handgun, even during transit to and from a place of work, when the weapon is being used in the line of duty. Furthermore, there is provided a device and method for receiving reminders, additional data and information as to the location, and status of a weapon, including but not limited to: automatically, by use of default settings, by specific demand of the user or another authorized user. Furthermore, there is provided a device and method for remotely securing a weapon, where the integral body of the weapon is not modified.

BRIEF DESCRIPTION OF THE DRAWINGS

Various embodiments are herein described, by way of example only, with reference to the accompanying drawings, wherein:

FIG. 1A-H are various views of an innovative exemplary holster of the immediate invention with or without an illustrative gun shown therein;

DESCRIPTION OF THE PREFERRED EMBODIMENTS

Figure 1B:
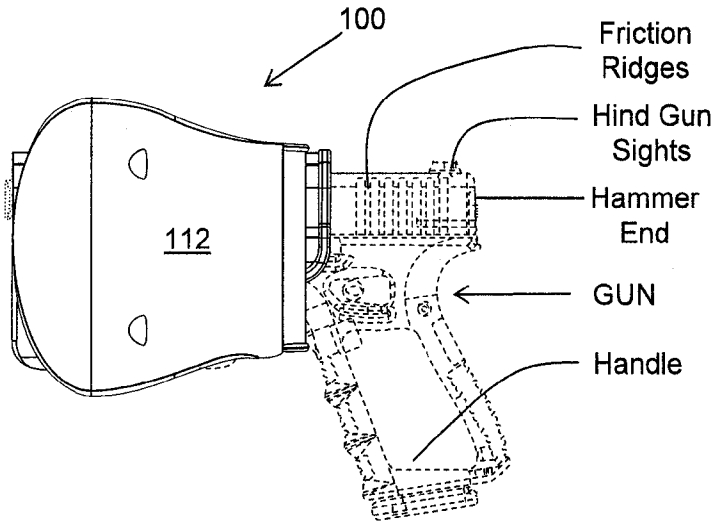

The principles and operation of a remotely activated lock according to the present invention may be better understood with reference to the drawings and the accompanying description.

Innovatively, the system for remotely activating gun and utility locks provides control over gun and utility locks by an authorized external device and/or from a remote location. The locks themselves can come in virtually any configuration, where the locking mechanism can be actuated electronically. While most locks generally have two states, locked and unlocked, various other interim states are also envisioned. For example, a spring-loaded latch has a beveled side and a straight side, allowing an object to push the latch out of the way in one direction but not the other (like the latch of door), once the object passes the latch from the direction of the beveled side, the latch springs back into place. A mechanical lever is usually manipulated to open the latch. A latch can also be locked so that the lever cannot be manipulated without first unlocking the latch lock or lever mechanism. In some cases, the spring-loaded latch can also be locked in place so that the latch does not retract even when an object pushes against the beveled side. Whatever the configuration of the locking mechanism, the locking member is referred to herein as a 'locking tab'.

Taking the aforementioned into consideration, it is made clear that the terms 'lock' and 'unlock' (and variations thereof) are not intended to be limiting, but may rather refer to a partial state, such as partially locked or partially unlocked. The general rule being that a "locked state" is a state wherein at least partial movement of at least part of a locking mechanism is restricted relative to a corresponding "unlocked state" which is a state wherein there is at least partial freedom of movement of at least part of a locking mechanism, relative to a corresponding locked state.

The locking tab is actuated (locked, unlocked, activated, deactivated, opened, closed, etc.) by a control signal sent to the lock via wired or wireless means. The control signal may be any type of electrical or acoustic signal or any other type of transmittable signal. For example, the lock can receive a signal from a source through a wired connection, such as a cable. In another example, the lock can receive a wireless signal. In the latter case, the signal may come from a local/short-range wireless source or from a more remote wireless source. A signal coming from a local wireless source may be transmitted using shot-range wireless technology such as Bluetooth, WiFi, NFC, RFID or any of the other technologies capable of relatively short-distance transmissions. A signal coming from a more remote wireless source may be transmitted using cellular voice or data technology or satellite technology (e.g. GPS technology). The lock itself may include one or more technologies for receiving the aforementioned control signal.

In some embodiments, the lock or lock housing not only receives signals but also transmits signals. For example, a lock may include a wireless transceiver which is capable of both receiving wireless signals as well as transmitting wireless signals. In some embodiments the lock or lock-housing transmits a signal which allows the lock to be tracked remotely. Various security and encryption protocols can be used to encrypt the signal and/or secure the lock from tampering by third parties. Each of the aforementioned configurations will be discussed in greater detail below.

Smart Holster

Figure 1D:
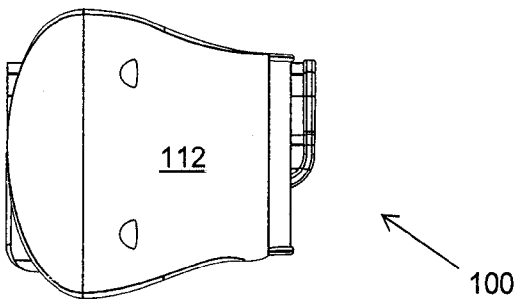
Figure 1A:
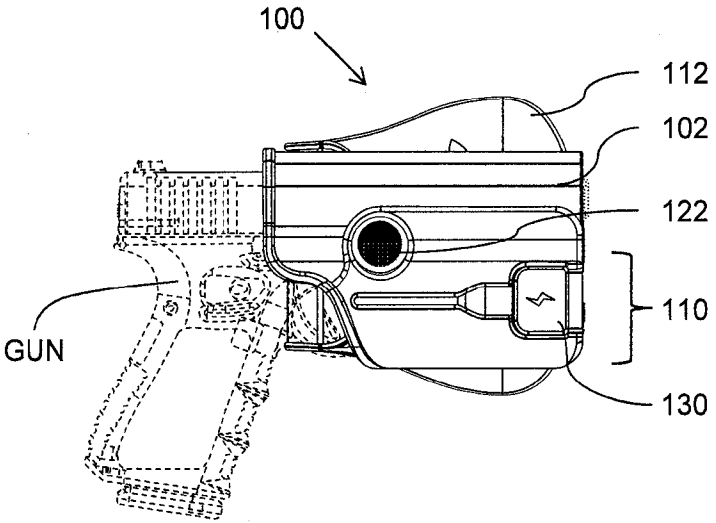
Figure 1C:
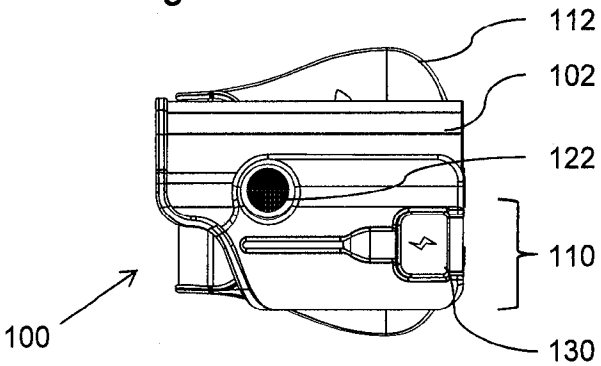

Referring now to the drawings, FIGS. 1A and 1B are outer-side and strap-side views of an exemplary embodiment of the invention, wherein an innovative safety mechanism is integrated into a safety pistol holster 100 with an exemplary gun illustratively holstered therein (for illustrative purposes only). FIGS. 1C and 1D are the same views as FIGS. 1A and 1B respectively, except without the illustrative gun holstered therein. FIG. 1E is a handle-end view of holster 100. FIG. 1F is a muzzle-end view of holster 100. FIG. 1G is a top view of holster 100. FIG. 1H is an isometric muzzle-end view of holster 100.

Referring now to FIGS. 1A-H, the pistol holster serves as an innovative gun lock for a gun inserted in the holster. Exemplary pistol holster 100 includes a holster body consisting of outer wall 102, a strap-side wall 104 a contoured top wall 106, an under wall 108. The holster body includes spaced apart strap-side and outer-side substantially rigid sidewalls formed to define an inner cavity and an open handle-end portion for receiving a weapon therein, and for removing the weapon there from. The holster body has a long axis parallel with the barrel of the weapon when secured in the holster body.

The security holster also includes a trigger-guard enclosure 110 which is closed on four sides (outer side, strap-side, under side and front/muzzle side; the handle side of the enclosure is open for receiving at least part of the trigger-guard of a weapon). The trigger guard enclosure 110 defines a space that is sized, proportioned and adapted to receive at least part of a trigger-guard portion of a firearm, and in some embodiments, the entire trigger-guard (at least the exposed portions of the trigger-guard). The trigger-guard enclosure is designed to enclose a trigger-guard of a weapon and prevent a finger of a user from accessing a trigger of a weapon, when inserted in the enclosure.

In some embodiments, the trigger-guard enclosure includes at least spaced apart strap-side and outer-side substantially rigid sidewalls formed to define an inner cavity and an open handle-end portion for receiving the trigger-guard of a weapon therein and for removing the trigger-guard there from. The trigger-guard enclosure has a long axis parallel with the trigger guard of a weapon when secured in the trigger-guard enclosure.

A belt-strap member 112 is affixed to the strap-side wall 104 and adapted for receiving a belt through a fold in the material which defines a U-shaped portion adapted to receive a pant belt there-through. Exemplarily, the belt strap member is formed from a rigid yet springy material (e.g. metal or hard plastic and the like) which is shaped to form a clasp which can be fastened onto a belt or the upper edge of the pants, at the waist line.

The invention includes an electronically actuated locking mechanism actuated by an external device and/or from a remote source. The electronically actuated locking mechanism is configured to admit a weapon into the safety holster, and to engage a feature of the weapon, thereby preventing the withdrawal of the weapon prior to release of the electronically actuated locking mechanism. In one embodiment the locking mechanism automatically engages a feature of the weapon inserted into the holster. In another embodiment, the locking mechanism is only actuated on command, where the control signal for that command is received from the authorized external device and/or from the remote source.

In the Figures, holster 100 includes a substantially circular plate 122 located on outer wall 102. In one exemplary embodiment, the locking mechanism includes a locking tab (not shown) which extends from substantially circular plate 122 down to trigger-guard enclosure 110. In some embodiments, the locking tab/latch is further spring loaded. In some embodiments, the latch further includes a beveled side facing the open side of trigger-guard enclosure 110 and a straight side facing the opposite direction (i.e. the direction of the muzzle of the firearm). In these embodiments (referred to hereinafter as a 'spring-latch'), when a firearm is inserted/seated in holster 100, the trigger guard of the weapon pushes past the spring latch which then springs back into place, automatically locking the firearm in the holster. In order to retrieve the weapon from the holster, a lever mechanism must be manipulated to withdraw the latch from within the trigger guard and allow the weapon to be removed. In one exemplary embodiment, circular plate 122 is part of a lever mechanism. Depressing spring-loaded plate 122 (e.g. with a forefinger), allows the user to extract the weapon from the holster. Innovatively, locking mechanism and/or plate 122 is electronically locked/unlocked. In some embodiments, the locking tab is moveably actuated electronically from a closed/locked position to an open/unlocked position.

In one exemplary variation of the above, the locking tab is not spring-loaded, but rather reversibly movable between a first position and a second position either mechanically or electronically (e.g. by actuating an electromechanical solenoid operationally coupled to the locking tab). In the first position the locking tab is substantially flush with an inner side of the enclosure. In this position, the locking tab does not extend into trigger-guard enclosure 110. When the locking tab is in the first position, the locking tab is in an 'open state' whereby a weapon or firearm can be inserted and removed from the holster without impediment from the locking tab. In the second position, the locking tab extends into trigger-guard enclosure 110, obstructing free passage of a trigger guard in or out of the enclosure. Other similar configurations would be obvious to one skilled in the art.

In the immediate exemplary embodiment, when a weapon which has a trigger-guard is inserted into the holster (or at the very least the trigger guard is inserted into trigger-guard enclosure 110), the locking tab is in the first position (i.e. in the open state), allowing the weapon to properly enter the holster. Once the weapon is inside the holster, or at the very least part of the trigger guard is inside enclosure 110, and the locking tab is moved into the second position, the weapon is now locked inside the holster and the locking mechanism is now in the 'locked state'. In the second position, the locking tab traps the trigger guard of a weapon inside trigger-guard enclosure 110. The weapon/firearm cannot be removed from the holster and the trigger of the weapon is likewise inaccessible. When in the locked state, the firearm/weapon can safely and securely be transported from place to place without the fear of accidental misuse or intentional abuse. Of course, other configurations and embodiments of the latch lock would be obvious to those skilled in the art, and are considered to be within the scope on the invention. In other embodiments, the locking tab may secure a feature of the weapon other than the trigger guard. For example, the locking tab may secure the weapon by engaging the ejection port of the weapon, the aiming sight/sights, the hammer, the hammer end, the friction ridges and the like.

Various embodiments are envisioned for 'locking' and 'unlocking' the aforementioned locking mechanisms, and by generalization, other gun locks and utility locks. In the envisioned embodiments, the weapons are not modified in any way.

Wired

Figure 1J:
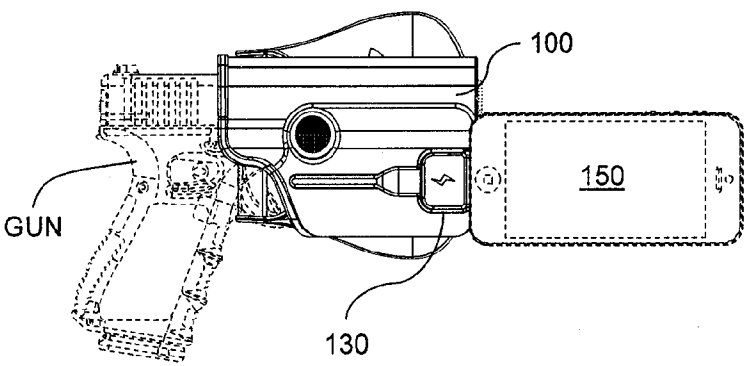
FIG. 1I-J are side views of the exemplary holster of FIGS. 1A-H coupled to an exemplary smartphone.
Figure 1I:
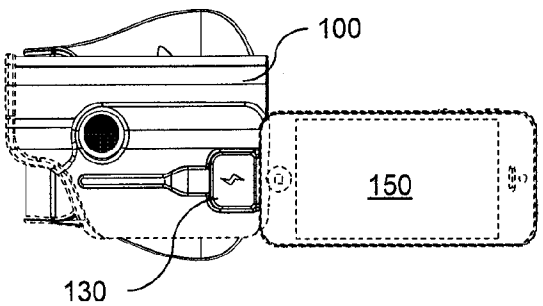

Exemplary holster 100 includes a data connector 130. In one exemplary embodiment the data connector is an OEM 30-pin data connector/docking port. In other embodiments the connector 130 is also, or alternatively, a power connector. In some exemplary embodiments, power/data connector 130 is adapted to be coupled to a mobile device. FIG. 1I is a side view of holster 100 coupled to a smartphone (e.g. an iPhone™ 4) via power/data connector 130. Alternatively and/or additionally, connector 130 may be configured to operationally connect to a tablet computer such as an iPad™ or similar device and/or a mini tablet or similar device and/or a palm-sized computing device such as a PDA and the like. FIG. 1J is a side view of holster 100 coupled to a smartphone via power/data connector 130, with an illustrative gun holstered therein.

Exemplary holster 100 further includes a micro USB port 132 which is adapted to receive data and/or power via a wired means such as a data and/or power cable with a micro USB connector head. It is clear that the type of data and/or power port is merely a result of design selection but could be substituted with any other equivalent data and/or power port.

Biometric

In one embodiment, the lock is a biometric lock. For example, the lock is protected by a fingerprint reader keyed to the authorized user of the firearm. The authorized user places an authorized finger on the reader which then unlocks the latch. For example, plate 122 may be a fingerprint reader. In other embodiments, the reader may be located in an alternative location on the holster. In still further embodiments, the reader may be operationally/electronically coupled to the holster in either a wired or wireless manner.

In a non-limiting example depicted in FIGS. 1I-J, the holster 100 is connected to a smartphone 150. In one embodiment, the smartphone has facial recognition software installed on the device. The user uses the mobile phone camera to capture the user's face and authenticate the user with the facial recognition software. Once authenticated, the software sends a release signal to the holster.

In other embodiments, the lock is actuated, activated or deactivated using voice controls and/or based on a pre-coded voice print. Modifications and variations of the aforementioned embodiments that would be clear to one of ordinary skill in the art, over all the known biometric access methods (e.g. fingerprints, retinal scan, facial recognition, DNA, palm print, hand geometry, iris recognition and odor/scent can be used in place of, or in addition to the aforementioned), are included in the scope of the immediate invention.

Short-Range Wireless

In another embodiment, the locking mechanism includes an RFID reader. When an authorized RFID tag, such as a ring or bracelet having the RFID tag integrated therein, comes into close contact with the holster (and hence the reader), the mechanism is unlocked.

In another embodiment, the holster includes a key-pad (letters, numbers, symbols, any combination thereof etc.) on which the user enters a PIN code.

In another embodiment, the holster includes, at least, a receiver capable of receiving short-range wireless signals. For example, the receiver may be an NFC (Near Field Communications) receiver, which can read a smartcard, smartphone, or any other NFC tag integrated or attached to a wearable or portable element. Bringing the NFC compatible element (smartphone, smart-watch, smartcard etc.) into 'contact' (as defined above) with the holster unlocks the holster, allowing the firearm to be extracted. Alternatively and/or additionally, the holster may include integrated BT technology. Further alternatively and/or additionally, the holster lock may be actuated by an IR (infra red) signal, or a WiFi signal and the like. The tag or signal is encoded and/or encrypted ensuring that only the authorized tag or signal will actuate the holster lock. It is clear, that the aforementioned embodiments are merely exemplary implementations of the innovative technology with an exemplary sampling of a few well known short-range wireless technologies. Modifications and variations of the aforementioned embodiments that would be clear to one of ordinary skill in the art, over all the known short-range wireless technologies, are included in the scope of the immediate invention.

Third-Party Actuation

The aforementioned embodiments, as well as variations of the same, are designed to allow an authorized user to release his or her own weapon (or unlock the lock) as well as prevent unauthorized removal of the weapon. For example, the locking mechanisms provide a safety feature in the home, by preventing a child from playing with a potentially loaded gun in a dangerous manner. In hostile situations, the locking mechanism prevents an unauthorized user from snatching the weapon from the user's holster to steal or use the weapon in a malicious manner.

In a second category, the locking mechanism (whether specific to the depicted holster, or another type of gun lock or a utility lock) is controlled or actuated or activated/deactivated by a third-party and/or from a remote location. Such an arrangement is preferred when the user is only authorized to use the firearm/weapon during the course of a duty shift or at a place of employment. For example, a security guard is issued a firearm (e.g. a handgun) for use on duty in a place of employment, e.g. in a bank. To continue the aforementioned example, the guard is issued the gun by a security firm and is entrusted with the gun which he ferries from home to the place of employment at the bank. Before a shift starts, the locking mechanism is deactivated/unlocked from a remote location, e.g. the security firm head office. The security guard can now remove the gun from the holster at any time during the shift. At the end of the shift, the holster is once again locked from the remote location.

The security guard then travels home and locks the gun away as per regulations. The difference being that the gun is locked in the holster the entire time and cannot be removed until the guard returns to duty.

From the specific example described above, various scenarios, variations, modifications and generalizations can be made. The example is a descriptive, enabling scenario wherein the innovative gun lock and supportive system can be implemented.

Using the context of the example above, the following additional generalizations can be made: In some embodiments, additional features ensure that the weapon is in the holster when the mechanism is locked. In some embodiments, the location of the holster (and hence the gun) is also tracked, either using satellite technology or cellular triangulation, to ensure that the guard is at the place of employment at the time of his duty shift, and only once the place and time have been verified, is the locking mechanism deactivated.

Some exemplary embodiments of activation/deactivation from a remote location are listed below:

In some embodiments, the holster (or other gun lock or utility lock) is attached directly or via a cable to a mobile phone, a portable computing device or a mobile device such as a smartphone which is both a cellular phone and a portable computing device. The mobile device (any of the aforementioned) received the activation signal from a remote location, either over the cellular network (voice, sms) and/or cellular data network and/or Internet and/or satellite connection. The signal may be an audio signal, a data packet, a text message (e.g. a PIN code that has to be entered manually) or any other electronic, audio or visual (including infra red) signal. In some embodiments, the wired connection is necessary merely to ensure that the mobile device is in close proximity to the locking mechanism, while the actual code is delivered in a different manner (e.g. by manually entering the code on a keypad, via short-range wireless signal, etc.). One exemplary embodiment of a holster connected to a smartphone is depicted in FIGS. 1I and 1J.

In other embodiments, the locking mechanism of the holster (or any other gun or utility lock) receives the signal from a mobile device (smartphone, tablet, laptop etc.) over short-range wireless technology or Local Area Wireless Communication (LAWC) technology. The signal is received by the mobile device from a remote location, via a cellular network (voice and/or data) and/or a computing network (or network of networks, such as the Internet) and/or satellite transmission, generally referred to as Wide Area Wireless Communication (WAWC). Once received by the mobile device, the signal is transmitted over the short distance between the mobile device and the holster (or other locking mechanism) thereby activating/deactivating the lock.

In other embodiments, the holster (or any other gun or utility lock) includes cellular and/or satellite technology integrated into the body of the holster. For example, the holster can include a SIM card slot and corresponding electronics which allow the holster to receive (and in some embodiments to send) signal from a remote location. The cellular technology not only affords long-distance wireless communication (i.e. receive and in some cases sending wireless signals) by further allows the location of the holster to be triangulated by known cell-tower triangulation methods. Alternatively and/or additionally, the holster may include GPS or GPS-like technology which allows for satellite tracking and/or communication.

Computer System

Figure 5:
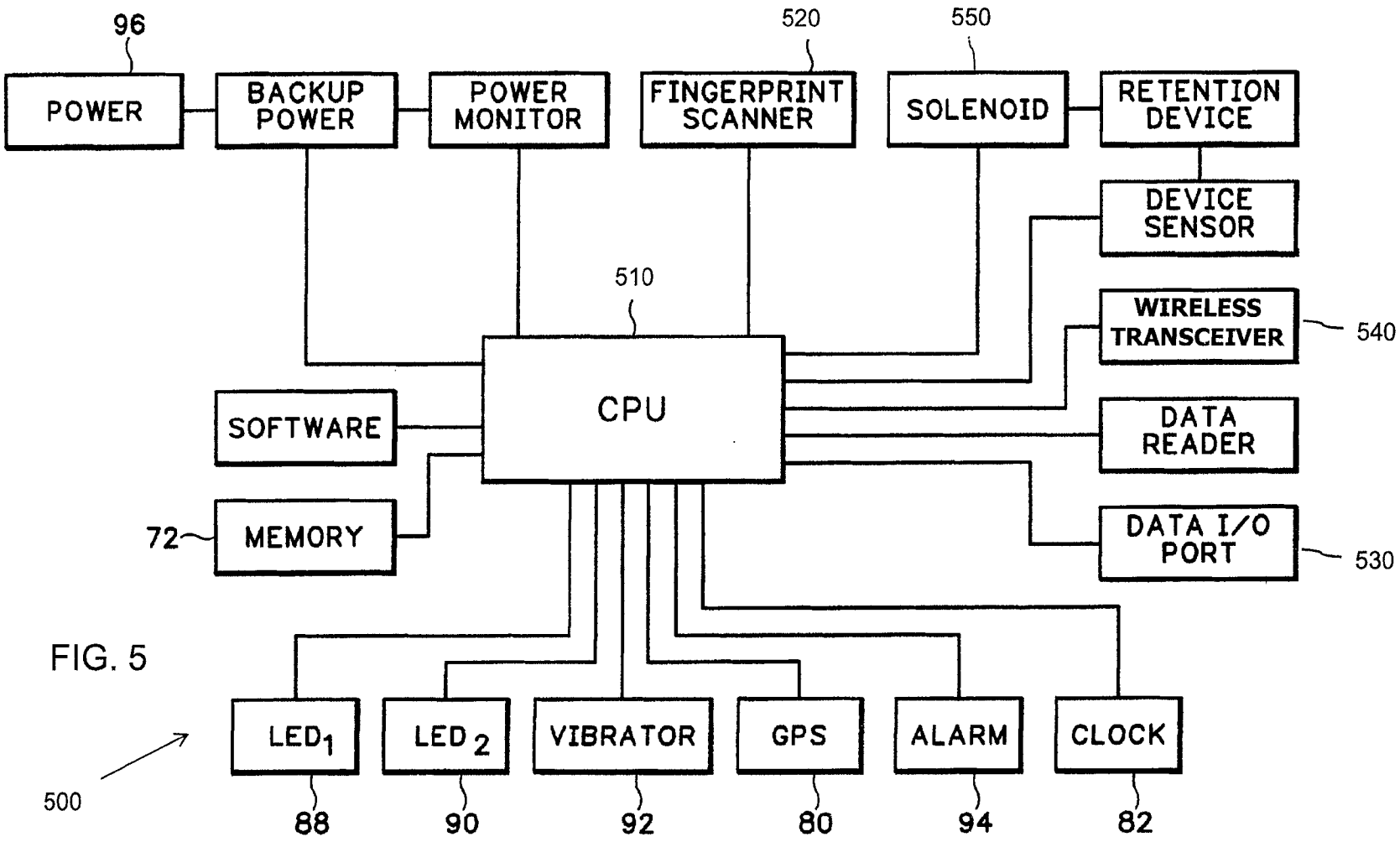
FIG. 5 is a block diagram of an exemplary computing system.

FIG. 5 depicts a schematic block diagram of a microcontroller unit (MCU) 500. Holster 100 further includes a MCU 500 which serves as a control system for the safety holster which is adapted to actuate the electronically actuated locking mechanism upon receipt of a control signal. The control system manages identification of an authorized individual or an authorization control signal (e.g. "lock", "unlock") to engage and/or lock or release and/or unlock the internal retention/locking device/mechanism and thereby prevent or allow withdrawal of the holster, and optionally to perform other functions as well.

In some embodiments, holster 100 has a microprocessor (CPU) 510 which is used to receive signals from an integrated biometric device 520, such as a fingerprint scanning device. In other embodiments CPU 510 receives and interprets the control signal from an external device which is operationally coupled to the holster. The external device may be coupled directly to the holster via a docking port or data connector, and/or in a wired manner and/or in a wireless manner. A control signal from an external device sent via a wired means or direct connection enters the system at a Data Input/Output (I/O) Port 530 and is received at the CPU. A wireless signal sent from an external device/source is received by the computing system at a wireless transceiver (or receiver) 540 and relayed from there to CPU 510. The holster 100 has memory 72, such as in the form of Electronically Erasable Programmable Read Only Memory (EEPROM), which is connected to the microprocessor 510. Collectively, CPU 510 and associated memory 72 comprise the computer system. The computer system which may be used in the present invention may be any device, whether a microprocessor alone or in combination with other processors and/or memory devices, which performs the functions described herein relating to the reading, writing, deleting, storing and comparing of information relating to signals received from the biometric device, as well as signals received from other input devices.

The computer system may also be built into the biometric device itself, or may be separate therefrom. In addition, the computer system may be incorporated either directly into the holster, or may be associated with the holster but not mounted on the holster body. Preferably, the computer system is located within the holster body. Alternatively, the computer system may be mounted within a support that is attached to the exterior of the holster. The support may be detachable so as to be replaceable. Alternatively, the computer system may be part of a modular assembly worn on the user's belt and connected to the holster through electrical connections.

In operation, the computer/control system controls the operation of the internal retention device/latch to allow withdrawal of the handgun. As shown in FIG. 5, microprocessor 510 is exemplarily connected to the biometric device, such as the fingerprint scanning device 520, as well as other optional inputs. The fingerprint scanning device and/or other biometric scanning devices may be embodied on the external mobile device. Data representative of the identifying characteristics of individuals, signal or codes authorized to open the holster may be stored in the memory 72. For example, when fingerprint scanning device 510 scans a fingerprint, a signal representative of the fingerprint is sent to CPU 510. The microprocessor compares the signal to the data stored in memory 72 to determine whether there is a match. If the identifying characteristic matches, then the microprocessor 510 generates a signal effective to release/unlock the internal retention device 124. For example, as shown in FIG. 5, the microprocessor is connected to a solenoid 550 so that when it receives the appropriate signal from the microprocessor, power is provided to the solenoid 550. Alternatively, the microprocessor may be connected to a switch or other device which causes power to be supplied to the solenoid. The power may by supplied from a local source or from the external mobile device. Alternatively and/or additionally the local power source may be powered, charged or recharged by the external mobile device.

The memory 72 used to store data may be any conventional memory device as described above. Thus, the memory may be integral to the computer system, such as a memory chip, may be in the form of a portable memory storage device such as magnetic storage media, or may be a combination thereof. Thus, the memory could include a portable magnetic or optical disk or diskette, or could be a smart card. For example, in one embodiment, the modular assembly may include a smart card reader capable of reading data stored on a smart card. The data representative of authorized users may be stored on the smart card. Inserting the smart card into the smart card reader allows data representative of the authorized individual to be easily installed in the computer system. The use of a portable memory storage device also provides an advantage in that authorized users may be easily changed. In addition, the portable memory storage device may be switched from one holster to another holster for a variety of reasons, if deemed necessary.

As yet another optional feature, the use of a portable memory storage device may be used as a key to allow authorization to withdraw the holster. The data representative of the individual may be prestored in a memory associated with the microprocessor. When a portable memory storage device is inserted into a data reader, the microprocessor checks for a match against the prestored data. If a match is found, the holster may be used. Otherwise, the holster remains inactive.

The holster may also optionally include a Global Positioning System (GPS) receiver 80 to determine the geographical location of the holster. The holster may also optionally include a clock 82. Signals from the GPS receiver and clock may be used as inputs for the computer system.

Other sensing devices may be used to sense insertion or withdrawal of a handgun. The holster may also include a variety of outputs which may be used to indicate the status of the holster, or to which data, signals or conditions may be sent to indicate the status of the holster or otherwise transmit information. For example, the holster may include one or more LEDs, such as LEDs 88 and 90, which may indicate certain conditions of the holster. For example, the microprocessor may send a signal to LED 88 when an authorized fingerprint has been scanned and the handgun may be withdrawn, but send a signal to LED 90 to indicate that a match has not been made. Alternatively, the holster may be equipped with a vibrator 92 connected to the microprocessor to perform the same function.

The holster may also include an alarm mechanism 94 to which a signal or data may be sent. The alarm mechanism 94 may be an audible alarm, such as a speaker, or could be a broadcast mechanism, such as a radio transmitter. In response to a signal from the switch 42 and/or the strain gauge 78, the microprocessor may send a signal, data or condition to the alarm mechanism 94. For example, where the alarm mechanism is a speaker, the alarm mechanism may simply emit a sound. Where the alarm mechanism 94 is a radio transmitter, the alarm mechanism may broadcast that an attempt has been made to withdraw a holster, as well as other data, such as the location of the holster, the time of withdrawal, and the identity of the individual attempting the withdrawal (if known). Alternatively, where the holster is used as a storage device, the alarm may be in the form of a signal to a home security system.

The holster may also optionally provide an audit of activity of the holster by storing data received from one or more of the inputs in response to certain input signals. For example, the microprocessor may store any or all of the data received from the fingerprint scanner, the strain gauge, the GPS receiver to record the location of an event, and/or the clock to record the time of the event.

The holster 100 may also include an input/output device to allow data to be retrieved from or sent to the memory 72 and/or instructions to be provided to the microprocessor. This may be accomplished in any conventional manner. The holster therefore may be used to receive or send data to a portable computing device and the ability to communicate over a cable. Data may also be transmitted using any other standard method for transmitting digital information, including any analog or digital telecommunication protocol, including wireless communication and communication over the Internet as discussed at length.

The computer system may also allow the holster to be disabled remotely. The computer system may be capable of receiving a signal from a remote location indicating that the holster should be disabled. In response, the computer system may disable the holster so that the retention device may not be released. Thus, for example, in response to an alarm indicating that an unauthorized attempt to withdraw the holster has occurred, a remote monitoring device could send a signal to the holster to disable the holster, preventing the retention device from allowing withdrawal of the handgun.

The computer system may also allow the holster to be disabled automatically in response to certain inputs. For example, the computer system may be capable of receiving a signal from either the clock or the GPS receiver. The computer system may be programmed so that the holster may be withdrawn only during specified times, or only within certain locations. Thus, if the user attempts to withdraw the handgun from the holster at an unauthorized time, or at an unauthorized location, the computer system disables the retention device so that the holster is disabled, thus preventing the retention device from allowing withdrawal of the handgun. Likewise, if the user attempts to withdraw the holster during an authorized time period, or at an authorized location, the computer system allows the handgun to be withdrawn from the holster.

Power for the various components of the holster may be provided in any conventional fashion. For example, the holster may include a power supply 96 such as a detachable power pack included as part of the support 108 of the modular assembly 74. Such a power supply may utilize standard batteries of any size, specialized material batteries (nickel, cadmium, lithium, etc.) of any size or a rechargeable module. The holster may also include electrical contacts so that the holster may be powered using conventional common voltages (110 v ac, 220/240 v ac or 12 v dc) to energize the solenoid and the related electronics. This would be desirable in circumstances in which the holster is used as a storage or security device, and/or to allow the power supply to be recharged. As mentioned above, the power may by supplied from a local source or from the external mobile device. Alternatively and/or additionally the local power source may be powered, charged or recharged by the external mobile device.

Any of the aforementioned embodiments, as well as variations of the same, can be implemented with other types of gun locks or utility locks, as would now be clear to one skilled in the art.

Trigger-Guard Safety Lock

Figure 2:
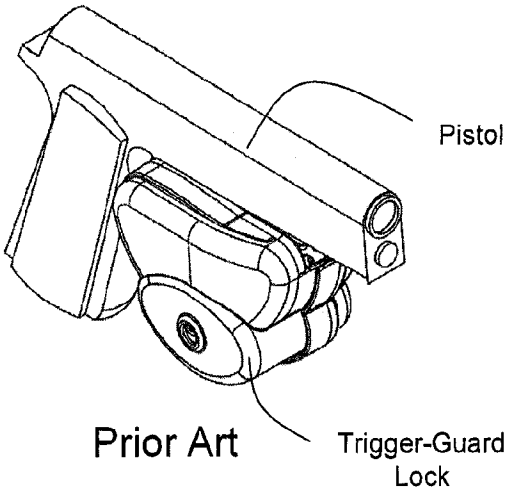
Fig. 2 Prior Art
FIG. 2 is a prior art depiction of a trigger-guard gun lock.

FIG. 2 depicts a prior art trigger-guard safety lock for a handgun. A conventional trigger lock includes two sections, a body section and a locking pin section, which are fitted together from either side of a trigger guard, through the space between the trigger and the trigger-guard, where the trigger finger is usually inserted, or behind the trigger. A key-type lock has a keyhole on one side and when the body and locking pin are fitted together, the key is turned to lock the pieces in place. The dimensions and design of the specific trigger lock prevent a user for inserting a finger into the trigger-guard space and pulling the trigger, as well as preventing a user from using the lock in place of a finger, to pull the trigger. In some trigger-guard locks, the lock also fits around at least part of the trigger-guard in order to anchor the lock on the gun.

Figure 3A:
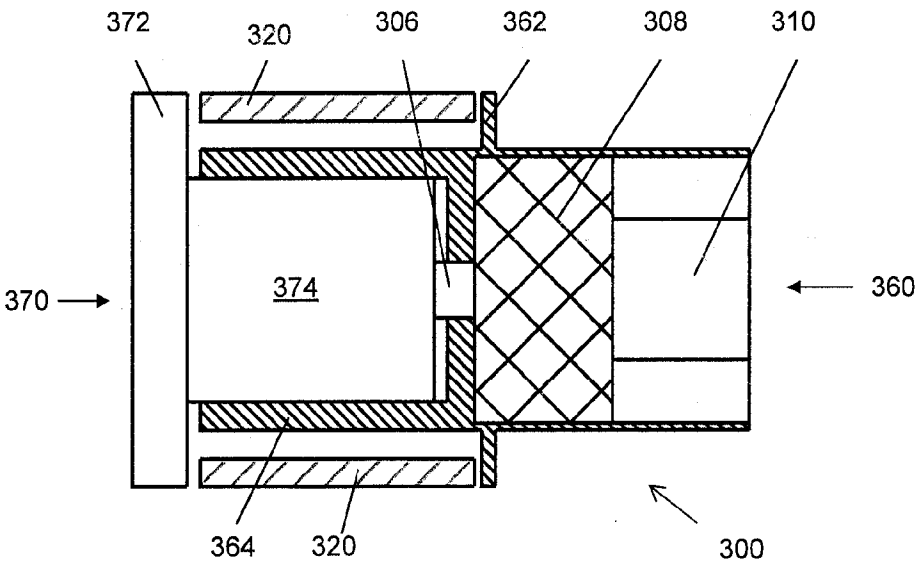
FIG. 3A is a cross-sectional view of a block diagram of a trigger-guard lock of the immediate invention.

FIG. 3A is a cross-sectional view of a schematic depiction of an exemplary trigger-guard lock 300 of the immediate invention. Lock 300 includes two attachable pieces, one is referred to herein as a body component 360 and the other referred to herein as a locking pin component 370.

The body component 360 includes a first plate or cover member 362 and a coupling element 364. The plate/cover member 360 has a surface area large enough to prevent the component from passing through the trigger-guard, from one side to the other and/or to restrict access to the trigger. Locking pin component 370 similarly includes a second plate or cover member 372, which substantially corresponds in size and shape to first plate/cover member 362 of body component 360. In one embodiment, the locking pin component further includes a shaft section 374 which is adapted to pass through an area defined by the trigger guard and gun/weapon frame (either behind the trigger or between the trigger and the trigger-guard) and fit into the coupling element section 364. A mechanical and/or electrical locking mechanism (not shown), or any locking mechanism which is electronically actuated, including a locking tab 306 (e.g. an electromechanical solenoid) movable between a locked and an unlocked position is adapted to releasably couple locking pin component 360 to body component 360 by locking shaft section 374 with coupling element 364 in a locked state and unlocking shaft section 374 from coupling element 364 in an unlocked state.

An electronic component/control system 308 serves as a control module for receiving signals and instructions on the one hand, and controlling at least release mechanism 306 on the other. Exemplarily, the control module includes a microcontroller unit (MCU) 500 such as depicted in FIG. 5. In other embodiments, only relevant elements of MCU 500 depicted in FIG. 5 are included in the MCU of the trigger guard lock 300. In the depicted embodiment, a connection port 310 includes a Data I/O port (e.g. similar to Data I/O Port 530) and/or a power port, which is some embodiments is adapted for a wired connection, e.g. via a USB connector [cable] (such as data and/power cable 314 and USB connector 312 of FIGS. 3B and 3C) and in some other embodiments is adapted for direct docking with an external device. In other embodiments, connection port 310 includes (additionally or alternatively) a wireless transceiver (e.g. such as or similar to Wireless Transceiver 540 in FIG. 5) which serves as the data gatekeeper which receives signals (and in some cases sends signals) from external sources and relays them to a microcontroller/microprocessor (e.g. such as CPU 510 in FIG. 5). In some embodiments, the wireless transceiver receives instructions from the CPU to send signals to the external sources. The wireless transceiver may be configured for handling signals from short-range wireless technology (LAWC) and/or long-range wireless technology (WAWC) discussed above. The top and bottom segments 320 of the trigger-guard are also visible in the Figure.

Figure 3B:
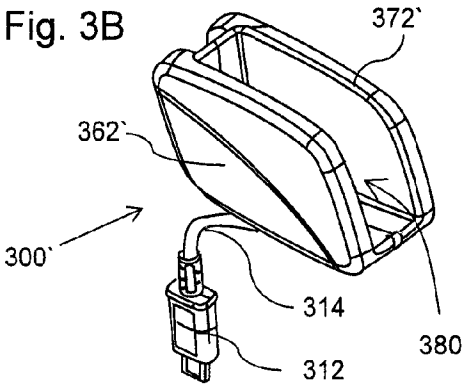
FIG. 3B is a back isometric view of an exemplary trigger-guard lock of the immediate invention.
Figure 3C:
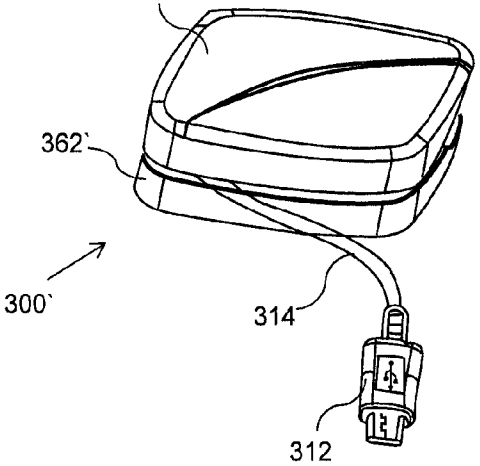
FIG. 3C is a bottom isometric view of the trigger-guard lock of FIG. 3B.
Figure 3D:
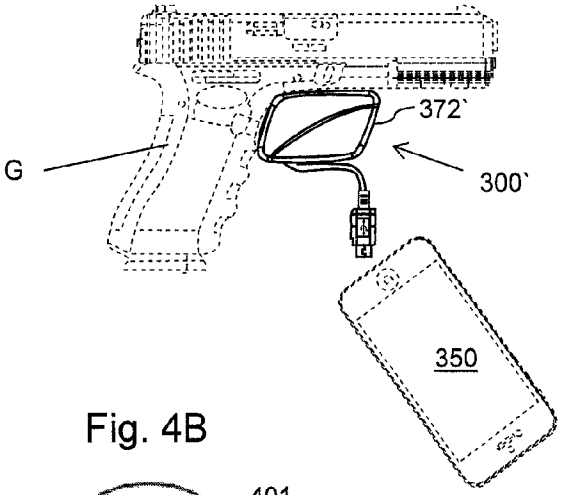
FIG. 3D is a side view of the exemplary trigger-guard lock of FIGS. 3B-C in place on an illustrative gun and poised an exemplary smartphone.

FIGS. 3B and 3C depict isometric back and bottom views respectively of an exemplary embodiment of innovative trigger-guard lock 300' which includes a USB connector 312 and cable 314. FIG. 3D depicts trigger-guard lock 300' illustratively positioned on an exemplary pistol G and poised to be coupled to an exemplary mobile phone 350 (or similar portable computing device) via a cable 314 and a USB connector 312. In FIG. 3B, an entry channel 380 is defined by a first cover element 362' coupled to a second cover element 372'. Both cover elements have side sections which are adapted to cover over the trigger-guard area of a gun. The cover elements also include bottom and front lips which are adapted, when the cover elements are coupled together, to form an L-shaped barrier, conforming substantially to the substantially L-shaped contour of a trigger guard of a gun. A locking mechanism (not visible in the Figures) is located near the intersection of the perpendicular front and bottom lips of the covers.

In the exemplary embodiment depicted in FIGS. 3B-3D, cable 314 extends from between the bottom lips of first cover element 362' and second cover element 372'. Cable 314 may be a data only cable, a data and power cable or a power cable only. Cable 314 extends from within trigger-guard lock 300' where the cable is connected to the control module (e.g. similar to control system/module 308 of FIG. 3A). Cable 314 terminates in an exemplary micro-USB connector 312. The connector is adapted to be coupled to an external device or source such as a mobile device 350 (e.g. a mobile phone and/or a portable computing device).

In one embodiment, the locking mechanism is a spring latch-type locking mechanism. A latch-type locking mechanism includes a spring-loaded locking tab which allows the trigger-guard of a gun to be inserted into the entry channel of the trigger lock, at which time the locking tab engages the trigger-guard and prevents removal of the trigger-guard from the trigger guard lock. The locking tab is movable between a locked and an unlocked position, engaging the trigger guard in the locked position. The locking tab is electromechanically controlled by a control system module (e.g. similar to control system/module 308 of FIG. 3A discussed above). The locking tab is unlocked/disengaged upon receiving a control signal from an external source/element.

In another embodiment, one of the cover elements is a cover element for a body component which includes the elements and configurations such as depicted for the body component 360 of FIG. 3A. The other cover element is part of a locking pin component similar to the locking pin component 370 described above. The components are separately positioned on either side of a trigger-guard and locked together about the trigger-guard in a manner which prevents actuation of the trigger. The lock is electromechanically actuated (engaged and/or disengaged) upon receiving a control signal from an external source/element.

In some embodiments, the depicted mobile device 350 relays a signal/code through cable 314 to lock 300'. The code/signal content can be generated locally (e.g. where the mobile device belonging to a management entity or an employment) or remotely. In the latter case, the code/signal is transmitted/relayed to the local device from a remote location, e.g. from a management entity—as described above with regards to the SMART HOLSTER embodiment.

An exemplary scenario, similar to the one described above is detailed below, with regards to the aforementioned, exemplary, trigger-guard lock.

At the end of a duty shift, when the weapon is no longer needed for the assigned job, the employee who intends to take the weapon home (or his employer) attaches the trigger lock to the gun. The gun is now locked and cannot be used.

The employee connects the USB cable between the lock mechanism and the mobile device and phones or otherwise contacts the employer or superior in charge. In some embodiments, an application on the smartphone sends a verification signal to the superior, verifying that the trigger lock is engaged. In some embodiments, GPS verification is received at the same time. In some embodiments, the innovative system records that weapon X is in the possession of employee Y in place Z. The employee can now take the inoperable weapon home.

With the beginning of a new duty shift (e.g. the next morning), the employee arrives at his place of work, and connects the trigger lock to the mobile device via the USB cable (in other embodiments, other electronic connections may be employed, such as a wireless connection over Bluetooth or the like, which can facilitate a similar connection as the USB cable). The employee contacts the superior who verifies that the employee is located in the place of work, based on the GPS data transmitted over the connection (from either the mobile device or from integrated components in the lock itself). The superior send a release signal/code over the phone (or other wireless means such as satellite, for example) to unlock the trigger lock. The weapon is now ready for use.

The release signal/code can be generated and/or stored in a management system. Once the code has been entered or transmitted to the lock, an electric gate opens admitting current to the power system of the lock effecting the locking or unlocking of the lock. In other embodiments the actuation process is different but results in the same outcome.

In some embodiments, the power needed for the system and/or the trigger lock is received from the mobile phone/device, negating the need for a power source on the lock itself.

Many variations to both the method and the system are readily obvious to one skilled in the art, and intended to be included within the scope of the invention.

Software/System Requirements

In some embodiments, a software/mobile application (app) that transforms the mobile device (potentially even a dedicated device such as a beeper, PDA, WiFi enabled phone and so on) into a work terminal with respect to the trigger lock.

In some embodiments, a Management System for managing the location, personnel, status etc. of the weapons registered with the system. Any variations of the system would be clear to one skilled in the art. For example one variation is that each business runs a unique management system. Another option is that a central company manages the entire system providing separate employer/manager and employee/user packages.

For example, a company that owns and operates an inventory of weapons can be provided with a management package to track and control the use and storage of the inventory. A shift manager is capable of knowing where each weapon is located, whether the weapon is locked or not. The system can provide an alert for a weapon in the possession of an employee/user that has gone off duty without locking the weapon.

In some embodiments, one or both the following steps (or equivalents thereof) are taken to ensure that the trigger lock is in place and engaged:

1. The duty officer (or equivalent) checks and ensures that the trigger lock is in the correct position.

2. A control system [remotely] tracks the trigger lock ensuring that the lock is engaged and in the correct location. In one example, the trigger lock is operationally coupled to a personal weapon such as a hand gun. In another example, the trigger lock is operationally coupled to a larger caliber weapon such as an assault rifle or a shotgun. In fact, any weapon which is portable and has a trigger and a trigger guard (or other similarly viable actuating arrangement) can be secured, monitored and otherwise tracked by an external device, and possibly from a remote location.

In some embodiments of the invention, the system is built into the gun/weapon initially. In other embodiments, described above, no changes, modifications or tooling are made to the weapon. A further advantage is preventing children from hurting themselves or other while playing with a weapon that has not been properly secured.

The immediate system can be adapted for use in opening doors, locks and the like. Regular locks are mechanically locked by a spring, key or combination lock. Lock mechanisms according to the immediate invention can be opened and locked without a key.

Utility Locks

Figure 4B:
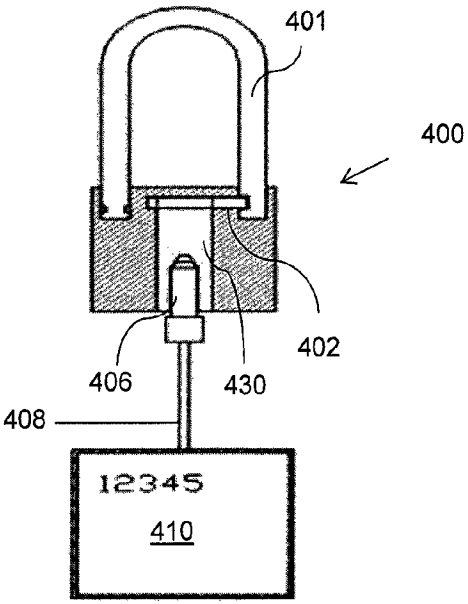
FIG. 4B is a cross-sectional facing view of the utility lock of FIG. 4A with a wired connection.
Figure 4A:
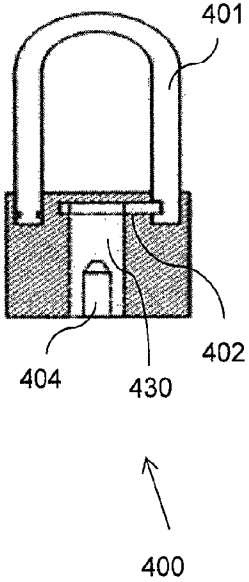
FIG. 4A is a cross-sectional facing view of an innovative locking mechanism of the immediate invention integrated into a utility lock.

FIG. 4A depicts an innovative locking mechanism incorporated in a generic-design utility padlock unit 400. An electronically actuated retention mechanism 402 includes a data (I/O) port 404 which are coupled together by an MCU 430 (e.g. similar to MCU 500 depicted in FIG. 5). The MCU controls the retention mechanism and receives signals via the data port. The data I/O port may additionally or alternatively be a power port for receiving power from an external source to power the MCU and retention mechanism. In the depicted embodiment, the data port receives a connector. In some embodiment, the data (I/O) port is additionally or alternatively configured to receive (and in some cases send) wireless signals. In a hybrid embodiment, the data port is configured to receive a physical connector (e.g. a USB connector) and the connector itself is capable or handling (receiving and sending) wireless signals (in a manner reminiscent of a wireless mouse or keyboard which are connected to the computer via a wireless USB connector). Various other embodiments will now be obvious to one of ordinary skill in the art, and are considered to be within the scope of the immediate invention.

FIG. 4B depicts the locking apparatus of FIG. 4A, coupled to an external device. A connecting pin (any type of connector) 406 connects a mobile device 410 to the lock apparatus 400, via a cable 408 or incorporated pin/jack. In an exemplary scenario, the mobile device sends an encrypted code or encoded signal to the locking mechanism which is received and decoded or decrypted by the MCU. The MCU, after receiving authorization or verification from the code or signal, instructs retention mechanism 402 to release locking bar 401. In some embodiments, an electric/electronic gate is instructed to admit current from the mobile device (or other power source), to release the retention mechanism and open the lock.

In some embodiments of the invention, locking and unlocking doors, for various uses, can be effected by direct connection via a cable, a wireless connection and the like. Where no physical connection exists and where the wireless signal does not cause an electrical response, the locking mechanism includes a power source (battery or electricity operated) for actuating the mechanism.

While the invention has been described with respect to a limited number of embodiments, it will be appreciated that many variations, modifications and other applications of the invention may be made. Components, methods, systems and devices described with relation to one embodiment of the invention are understood to equally apply, where relevant and/or according to relevant modifications, to other embodiments discussed herein. Therefore, the claimed invention as recited in the claims that follow is not limited to the embodiments described herein.

What is claimed is:

1. A safety holster for use with a weapon, the weapon having a barrel, a slide, a trigger guard, a trigger, an ejection port, a hammer end and a handle, wherein the holster comprises:

a holster body that includes spaced apart strap-side and outer-side substantially rigid sidewalls formed to define an inner cavity and an open handle-end portion for receiving a weapon therein, and for removing said weapon there from, said holster body having a long axis parallel with the barrel of said weapon when secured in said holster body;

an electronically actuated, bistable locking mechanism including a displaceable member, said displaceable member being displaceable between a first position corresponding to a locked state of said locking mechanism and a second position corresponding to an unlocked state of said locking mechanism; and a control system including a microcontroller and an actuator, said microcontroller being configured such that, upon receipt of a locking control signal from a mobile cellular device said microcontroller actuates said actuator to move said displaceable member into said first position, thereby preventing withdrawal of said weapon and, upon receipt of an unlocking control signal from said mobile cellular device, said microcontroller actuates said actuator to move said displaceable member into said second position, thereby allowing withdrawal of said weapon.

2. The safety holster of claim 1, further comprising a trigger-guard enclosure that includes spaced apart strap-side and outer-side substantially rigid sidewalls formed to define an inner cavity and an open handle-end portion for receiving the trigger guard of said weapon therein, and for removing the trigger-guard of said weapon there from, said trigger-guard enclosure having a long axis parallel with the trigger guard of the weapon when secured in said trigger-guard enclosure.

3. The safety holster of claim 1, further comprising a data connector, adapted for operationally coupling said electronically actuated locking mechanism to said mobile cellular device.

4. The safety holster of claim 3, wherein said data connector is a docking port for said mobile cellular device.

5. The safety holster of claim 3, wherein said data connector is operationally coupled to said mobile cellular device via a wired means.

6. The safety holster of claim 5, wherein said data connector is also a power port for receiving power from said mobile cellular device.

7. The safety holster of claim 1, wherein said mobile device is a satellite communications device.

8. The safety holster of claim 1, wherein said mobile device is a portable computing device.

9. The safety holster of claim 1, wherein said control signal is received via a wired communication.

10. The safety holster of claim 1, wherein said control signal is received via a wireless communication.

11. The safety holster of claim 10, wherein said wireless communication is a Local Area Wireless Communication (LAWC).

12. The safety holster of claim 10, wherein said wireless communication is a Wide Area Wireless Communication (WAWC).

13. The safety holster of claim 12, wherein said mobile device receives said control signal from a remote source over WAWC technology.

14. The safety holster of claim 1, wherein said control signal is sent only after a biometric sample has been captured and approved via said mobile device.

15. The safety holster of claim 14, wherein said biometric sample is selected from the group consisting of: a fingerprint, a retinal scan, facial recognition, and a voice print.

16. The safety holster of claim 1, wherein said control signal is sent only after a geospatial position of the security holster is ascertained and approved.

17. The safety holster of claim 16, wherein said geospatial position is ascertained and approved via said mobile device.

18. The safety holster of claim 1, wherein said locking mechanism is adapted to respond to said control signal and said mobile cellular device is adapted to send said control signal independent of proximity of said mobile cellular device to said holster body.

19. The safety holster of claim 1, wherein said locking mechanism is adapted to remain in said locked state or said unlocked state until a respective control signal is received from said mobile cellular device, said control signal being transmitted between said mobile cellular device and the safety holder independent of proximity of said mobile cellular device to the safety holder.

20. The safety holster of claim 1, further comprising a sensor for detecting insertion or withdrawal of the weapon.

21. The safety holster of claim 20, wherein the safety holster outputs data relating to whether the weapon is inserted therein or withdrawn therefrom.

22. A trigger lock for a weapon having a frame, a trigger and a trigger guard, the trigger lock comprising:

a trigger-guard enclosure including a body component and a locking pin component, that together define an inner cavity and an open entry channel for receiving the trigger guard of a weapon therein, and for removing the trigger-guard of said weapon there from, said trigger-guard enclosure having a long axis parallel with the trigger guard of the weapon when secured in said trigger-guard enclosure;

an electronically actuated, bistable locking mechanism including a displaceable member, said displaceable member being displaceable between a first position corresponding to a locked state of said locking mechanism and a second position corresponding to an unlocked state of said locking mechanism; and a control system including a microcontroller and an actuator, said microcontroller being configured such that, upon receipt of a locking control signal from a mobile cellular device said microcontroller actuates said actuator to move said displaceable member into said first position, thereby preventing withdrawal of the trigger guard from the trigger guard lock and, upon receipt of an unlocking control signal from said mobile cellular device, said microcontroller actuates said actuator to move said displaceable member into said second position, thereby allowing withdrawal of the trigger guard from the trigger guard lock.

23. The trigger lock of claim 22, wherein said electrically actuated locking mechanism includes a locking tab movable between a locked position in said locked state and an unlocked position in said unlocked state.

24. The trigger lock of claim 22, wherein said body component includes a first cover member and a coupling element, said cover member having a surface area large enough to restrict access to the trigger and said locking pin component includes a second cover member, substantially corresponding in size and shape to said first cover member:

said locking pin component further including a shaft section which is adapted to pass through an area defined by said trigger guard and a frame of said weapon, and fit into a coupling element of said body component;

said body and locking pin components are separately positioned on either side of the trigger-guard and locked together about the trigger-guard in a manner which prevents actuation of the trigger;

said electrically actuated locking mechanism including a locking tab movable between a locked and an unlocked position adapted to releasably couple said locking pin component to said body component by locking said shaft section with said coupling element in said locked state and unlocking said shaft section from said coupling element in said unlocked state.

25. The trigger lock of claim 22, further comprising a data connector, adapted for coupling said mobile cellular device to the trigger guard lock.

26. The trigger lock of claim 22, wherein said control system further includes a wireless transceiver adapted to receive wireless transmissions from said mobile cellular device.

27. The trigger lock of claim 22, further comprising a sensor for detecting insertion or withdrawal of the weapon.

* * * * *